US005467052A

United States Patent [19]

Tsukada

[11] Patent Number: 5,467,052

[45] Date of Patent: Nov. 14, 1995

[54] REFERENCE POTENTIAL GENERATING CIRCUIT UTILIZING A DIFFERENCE IN THRESHOLD BETWEEN A PAIR OF MOS TRANSISTORS

[75] Inventor: Shyuichi Tsukada, Tokyo, Japan

[73] Assignee: NEC Corporation, Tokyo, Japan

[21] Appl. No.: 284,138

[22] Filed: Aug. 2, 1994

[30] Foreign Application Priority Data

Aug. 2, 1993 [JP] Japan ..... 5-191047

[51] Int. Cl.[6] ..... G05F 3/02; G05F 1/10

[52] U.S. Cl. ..... 327/543; 327/538; 327/331; 327/513

[58] Field of Search ..... 327/331, 513, 327/534, 535, 537, 538, 539, 543, 540, 541; 323/313, 315

[56] References Cited

U.S. PATENT DOCUMENTS

| | | | |
|---|---|---|---|
| 3,823,332 | 7/1974 | Feryszka et al. | 327/541 |
| 4,049,980 | 9/1977 | Maitland | 327/541 |
| 4,199,693 | 4/1980 | Bennett | 327/543 |

OTHER PUBLICATIONS

"A Tunable CMOS–DRAM Voltage Limiter with Stabilized Feedback Amplifier", by M. Horiguchi et al., 1990 Symposium on VLSI Circuits, pp. 75–76.

*Primary Examiner*—Timothy P. Callahan

*Assistant Examiner*—Jung Ho Kim

*Attorney, Agent, or Firm*—Sughrue, Mion, Zinn, Macpeak & Seas

[57] ABSTRACT

An MOS reference voltage generating circuit is provided which has a simplified circuit that eliminates the need for a feedback circuit and a large compensating capacitor, and reduces the current consumption of the device. This is achieved by utilizing a new circuit configuration which is simplified. The simplifier reference potential generating circuit comprises a first PMOS transistor having its gate and its drain connected in common to a first node and its source connected to Vcc, a second PMOS transistor having its gate and its drain connected in common to a second node and its source connected to Vcc, a resistor connected between the first node and the second node, and a first current source connected between the first node and ground. A third PMOS transistor is connected at its gate to the second node and at its source connected to Vcc, so that a current mirror is constituted of the second and third transistors. A fourth PMOS transistor is connected at its source connected to a drain of the third PMOS transistor. A gate of the fourth PMOS transistor is connected to the first node, and a drain of the fourth PMOS transistor is connected to one end of a second resistor having its other end grounded. A reference potential is generated from the one end of the second resistor and is independent of variations in the supply voltage and temperature. This simplified circuit is compatible with standard CMOS processing allowing for low cost manufacturing while obtaining improved operation and reduced circuit area.

6 Claims, 4 Drawing Sheets

REFERENCE POTENTIAL GENERATING CIRCUIT UTILIZING A DIFFERENCE IN THRESHOLD BETWEEN A PAIR OF MOS TRANSISTORS

BACKGROUND OF THE INVENTION

1. Field of the Invention

The present invention relates to a reference potential generating circuit, and more specifically to a reference potential generating circuit utilizing a difference in threshold between MOS transistors having different threshold voltages.

2. Description of Related Art

Characteristics generally required in reference potential generating circuits is that (1) a reference potential is ceaselessly at a constant independent of a voltage supply voltage, and (2) the reference potential is always at a constant regardless of temperature variation.

Referring to FIG. 1, there is shown a band-gap reference type reference potential generating circuit which can meet with the above mentioned demands and which has been widely used. The shown circuit is composed of bipolar transistors, and has an advantage in that a generated reference potential has an extremely small variation independent of a temperature variation and of a very large voltage supply voltage ranging from several volts to several tens of volts. However, in the ease that this reference potential generating circuit is incorporated into a CMOS semiconductor integrated circuit such as a memory, new problems are encountered in that a process for manufacturing the bipolar transistors must be newly added into the manufacturing process for the CMOS integrated circuit, and several hundred microamperes of current are additionally required for operation of this reference potential generating circuit.

Under this circumstance, a reference potential generating circuit composed of CMOS transistors as shown in FIG. 2 has been proposed and actually used. The shown CMOS reference potential generating circuit was proposed by M. Horiguchi, et al in "1990 Symposium on VLSI Circuits", pp 75–76. This proposed reference potential generating circuit is configured to generate a reference potential for a step-down voltage supply which is used to internally step down an external voltage supply voltage.

In a threshold voltage difference generating circuit 10, a PMOS (P-channel MOS) transistor $Q_1$ is manufactured to include a channel region having an impurity diffusion concentration which is different from that of a PMOS transistor $Q_2$, so that the PMOS transistor $Q_1$ has a threshold in absolute value larger than that of the PMOS transistor $Q_2$.

Each of PMOS transistors $Q_1$ and $Q_2$ have its gate and its drain connected to each other, so that the threshold of each transistor appears between a source and the drain. Therefore, a voltage, which is a difference in threshold between the transistors $Q_1$ and $Q_2$, will appear on a node VR, independently of a voltage supply voltage $V_{CC}$.

In addition, since both of the transistors $Q_1$ and $Q_2$ are governed by P-type carriers, the temperature coefficient of the threshold of these transistors $Q_1$ and $Q_2$ are substantially equal to each other. Accordingly, the voltage appearing on the node VR has less temperature dependency.

The node VR is connected to one input of a differential amplifier 12, which has an output connected to a gate of a PMOS transistor $Q_7$, and a voltage on a node VL is divided by a trimming circuit 14 and fed back to the differential amplifier. Therefore, on the node VL there is generated a voltage obtained by multiplying the voltage of the node VR by an integer determined by a dividing ratio of the trimming circuit 14 This trimming circuit 14 includes a plurality of fuses, so that a desired voltage can be generated on the node VL by trimming the fuses in the trimming circuit 14 after completion of diffusion steps in the manufacturing process.

The voltage on the node VL is used as a reference potential of a step-down voltage supply, and does not almost vary dependently upon a voltage supply voltage variation and a temperature variation.

In the conventional CMOS reference potential generating circuit shown in FIG. 2, however, since the threshold voltage difference VR is amplified by a feedback type circuit, a sufficient caution in design is required to prevent an oscillating operation. In order to prevent the oscillating operation, it is required to make the capacitance of a compensating capacitor $C_1$ sufficiently large, and also to make a consumed current of the differential amplifier 12 (a current flowing through an NMOS (N-channel MOS) transistor $Q_8$) sufficiently large, so that the differential amplifier 12 quickly operates. According to study of the inventor, in order to prevent oscillation, it is necessary that the capacitance of a compensating capacitor $C_1$ is about 100 pF and the consumed current of the differential amplifier 12 is about 10 μA. In addition, considering a consumed current in the threshold voltage difference generating circuit 12 as well as a current flowing through the trimming circuit 14, this reference potential generating circuit requires a total consumed current of at least about 20 μA.

Furthermore, the capacitance of 100 pF needs a large area in a mask layout. At present, in addition, most of CMOS memories has a total consumed standby current on the order of a few microamperes to a few tens microamperes. In this case, the consumed current of the reference potential generating circuit becomes a large part of the total consumed current of the integrated circuit.

Moreover, there is a restriction that the threshold voltage difference VR is required to be about 1 V or more. In the circuit shown in FIG. 2, a voltage on a node D, namely, a drain voltage of the transistor $Q_8$, is on the order of ($VR-V_{TN}$) (where $V_{TN}$ is a threshold voltage of the NMOS transistor), and therefore, is low. The transistor $Q_8$ operates in a non-saturated region in a current-voltage characteristics, but the threshold voltage difference VR fluctuates in a range of about ±0.1 V because of variation in the manufacturing process. Accordingly, the current flowing through the transistor $Q_8$ greatly varies due to the fluctuation of the threshold voltage difference VR.

Accordingly, it must be designed that the threshold voltage difference VR is about 1 V or more even if the variation is the most severe, in order to ensure the high speed operation for preventing oscillation.

On the other hand, in a conventional CMOS process, the threshold value of PMOS transistors is controlled by diffusing P-type impurities such as boron to a channel region of the PMOS transistors. Therefore, a PMOS transistor having its channel region diffused with no impurity for controlling the threshold value, has a threshold larger in absolute value than that of a channel-diffused PMOS transistor. From this principle it can be considered to use, as the transistor $Q_1$, a PMOS transistor having its channel region diffused with no impurity for controlling the threshold value, so that the transistor $Q_1$ can have the threshold different from that of the transistor $Q_2$, so as to generate the threshold voltage difference VR. In this case, the threshold of the transistor $Q_1$ is determined by the impurity concentration of a well in which the transistor $Q_1$ is formed. The impurity concentration of the well is controlled by a device isolation of a diffusion layer, and therefore, it does not necessarily follow that the difference in threshold between the transistors $Q_1$ and $Q_2$ is about 1 V or more. If the threshold voltage difference is smaller than 1 V, it is necessary to add a process of diffusing N-type impurities to the channel region of the transistor $Q_1$ in order to enlarge the absolute value of the threshold of the transistor $Q_1$. This results in increase of the manufacturing cost.

All of the problems of the conventional example shown in FIG. 2 can be said to be attributable to the fact that the threshold voltage difference is amplified by the feedback circuit using the differential amplifier circuit. In the prior art, however, it is difficult to amplify the threshold voltage difference by a simple structure circuit other than the feedback circuit using the differential amplifier circuit.

SUMMARY OF THE INVENTION

Accordingly, it is an object of the present invention to provide a reference potential generating circuit which has overcome the above mentioned defect of the conventional one.

Another object of the present invention is to provide a reference potential generating circuit capable of generating a reference potential by use of a simple structure circuit other than the feedback circuit using the differential amplifier circuit, even if the threshold voltage difference is less than 1 V.

Still another object of the present invention is to provide a reference potential generating circuit which is constituted of a simple structure circuit other than the feedback circuit using the differential amplifier circuit, but which needs no capacitor of a large capacitance and has only a reduced consumed current.

The above and other objects of the present invention are achieved in accordance with the present invention by a reference potential generating circuit using MOS transistors having different thresholds and configured to generate a reference potential by amplifying a difference between the thresholds of the MOS transistors, the reference potential generating circuit comprising a first PMOS transistor having its gate and its drain connected in common to a first node and its source connected to a high voltage supply voltage, a second PMOS transistor having its gate and its drain connected in common to a second node and its source connected to a high voltage supply voltage, a resistor connected between the first node and the second node, a first current source connected between the first node and a low voltage supply voltage, a third PMOS transistor having its gate connected to the second node, its drain connected to a third node and its source connected to a high voltage supply voltage, a fourth PMOS transistor having its source connected to the third node, its gate connected to the first node and its drain connected to a fourth node, and a second resistor connected between the fourth node and a low voltage supply voltage, a reference potential being generated from the fourth node.

One embodiment of the reference potential generating circuit claimed in claim 1 further includes a means for adjusting a resistance of the first resistor, and/or means for adjusting a resistance of the second resistor.

Furthermore, the second PMOS transistor can include a plurality of second PMOS transistors connected in parallel to each other, so that at least one of the plurality of second PMOS transistors can be selectively separated so as to adjust a current flowing through the first resistor. Similarly, the third PMOS transistor can include a plurality of third PMOS transistors connected in parallel to each other, so that at least one of the plurality of third PMOS transistors can be selectively separated so as to adjust a current flowing through the fourth PMOS transistor.

In addition, the reference potential generating circuit can further include a differential amplifier circuit having an input connected to the fourth node, for buffering and amplifying the reference voltage appearing on the fourth node.

The above and other objects, features and advantages of the present invention will be apparent from the following description of preferred embodiments of the invention with reference to the accompanying drawings.

DESCRIPTION OF THE PREFERRED EMBODIMENTS

Figure 3A:
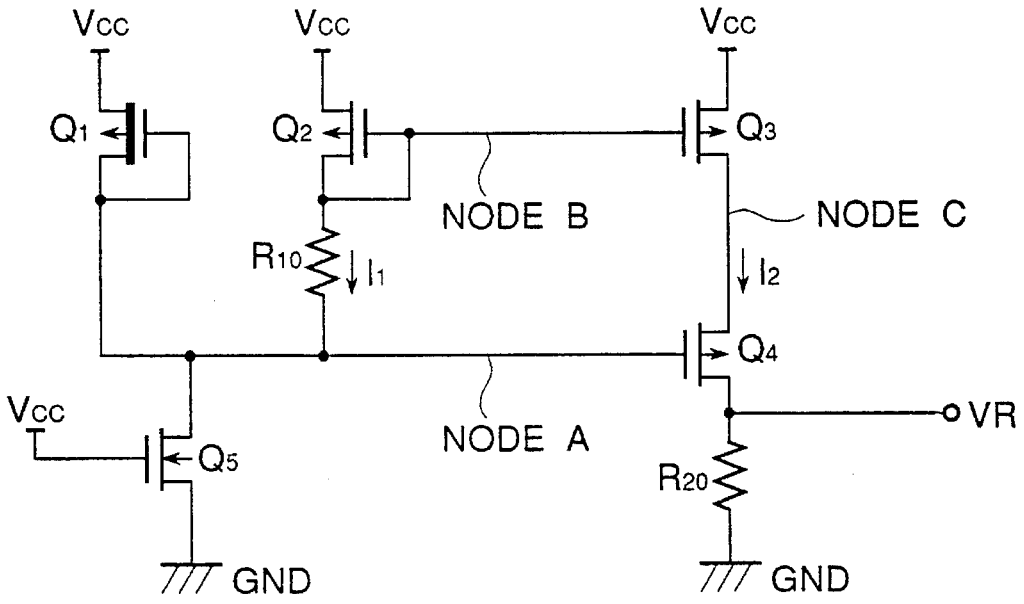
FIG. 3A is a circuit diagram of a first embodiment of the reference potential generating circuit in accordance with the present invention.

Referring to FIG. 3A, there is shown a circuit diagram of a first embodiment of the reference potential generating circuit in accordance with the present invention.

The reference potential generating circuit shown in FIG. 3A includes a PMOS transistor $Q_1$ having its gate and its drain connected to each other, and its source connected to a high voltage supply voltage $V_{CC}$, another PMOS transistor having its gate and its drain connected to each other and its source connected to the high voltage supply voltage $V_{CC}$, and a resistor $R_{10}$ connected between the drain of the transistor $Q_1$ and the drain of the transistor $Q_2$. Further, an NMOS transistor $Q_5$ is connected between a low voltage supply voltage or ground GND and the drain (called a node "A" hereinafter) of the transistor $Q_1$ connected to the resistor $R_{10}$. A gate of this NMOS transistor $Q_5$ is connected to the high voltage supply voltage $V_{CC}$. A PMOS transistor $Q_3$ is connected at its gate to the gate (called a node "B" hereinafter) of the transistor $Q_2$. A source of the transistor $Q_3$ is connected to the high voltage supply voltage $V_{CC}$. A PMOS transistor $Q_4$ is connected at its source to a drain (called a node "C" hereinafter) of the transistor $Q_3$. A gate of the transistor $Q_4$ is connected to the drain of the transistor $Q_1$ (the node A). Another resistor $R_{20}$ is connected between a drain of the transistor $Q_4$ and the low voltage supply voltage GND. A reference potential VR is extracted from the drain of the transistor $Q_4$.

Now, operation of this circuit will be described.

The PMOS transistor $Q_1$ has a threshold in absolute value higher or larger than that of the PMOS transistors $Q_2$ and $Q_3$. Since each of the transistors $Q_1$ and $Q_2$ has its drain and its gate short-circuited to each other, potentials on the nodes A and B are respectively lower than Vcc by the absolute value of the threshold of the respective transistors $Q_1$ and $Q_2$. Accordingly, a difference ΔVT in threshold between the transistors $Q_1$ and $Q_2$ is applied across the resistor $R_{10}$, independently of $V_{CC}$. Therefore, a current $I_1$ flowing through the resistor $R_{10}$ can be expressed as follows:

$$I_1=\Delta VT/R_{10} \quad (1)$$

On the other hand, the transistors $Q_2$ and $Q_3$ constitute a current mirror. Therefore, assuming that a transconductance constant of the transistors $Q_2$ and $Q_3$ are $\beta_2$ and $\beta_3$, respectively, a current $I_2$ flowing through the transistor $Q_3$ is expressed as follows:

$$I_2\cong(\beta_3/\beta_2)I_1=(\beta_3/\beta_2).(1/R_{10}).\Delta VT \quad (2)$$

Here, the fact that the current $I_2$ is approximately equal to the current $I_1$ multiplied by a ratio in transconductance constant between the transistors $Q_2$ and $Q_3$, is attributable to the fact that a source-drain voltage $V_{DS}$ of the two transistors $Q_2$ and $Q_3$ are different. In addition, since a current flowing through the resistor $R_{20}$ is equal to the current $I_2$, a voltage VR across the resistor $R_{20}$ is expressed as follows:

$$VR=I_2.R_{20}\cong(\beta_3/\beta_2).(R_{20}/R_{10}).\Delta VT \quad (3)$$

Figure 3B:
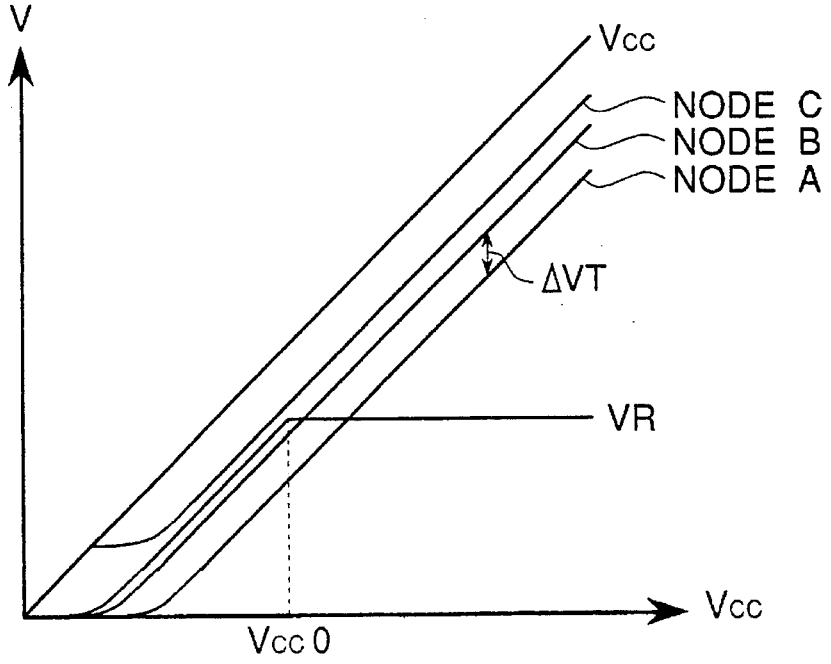
FIG. 3B is a graph illustrating potential changes on various internal nodes in the circuit shown in FIG. 3A.

Furthermore, because of the PMOS transistor $Q_4$, the potential on the node C is higher than the potential on the node A by the absolute value of a threshold of the transistor $Q_4$. Accordingly, the source-drain voltage $V_{DS}$ of the transistor $Q_3$ is independent of $V_{CC}$, and therefore, is maintained at a constant value. As a result, the current $I_2$ has no dependency to $V_{CC}$, and VR is at a constant voltage under the condition of $V_{CC}\geqq V_{CCO}$, as shown in FIG. 3B which is a graph illustrating dependency between potentials of various nodes in the circuit shown in FIG. 3A and the voltage supply voltage $V_{CC}$.

In equation (3), the temperature dependency of the transconductance constant and the temperature dependency of the resistance of the resistor are respectively cancelled between a numerator and a denominator. In addition, the threshold difference ΔVT is constant regardless of the temperature variation. Accordingly, the potential of the voltage VR is always maintained at a constant value independently of the temperature variation.

Furthermore, as will be seen from the equation (3), the voltage VR is a value obtained by amplifying the threshold difference ΔVT by the ratio between the transconductance constants of the transistors $Q_2$ and $Q_3$ and by the ration between the resistances of the resistors $R_{10}$ and $R_{20}$. Therefore, even if the threshold difference ΔVT is smaller than 1 V, the shown circuit can operate properly. Accordingly, the step of diffusing the N-type impurities to the channel region of the transistor $Q_1$ in order to increase the absolute value of the threshold of the transistor $Q_1$, is no longer necessary.

Figure 1:
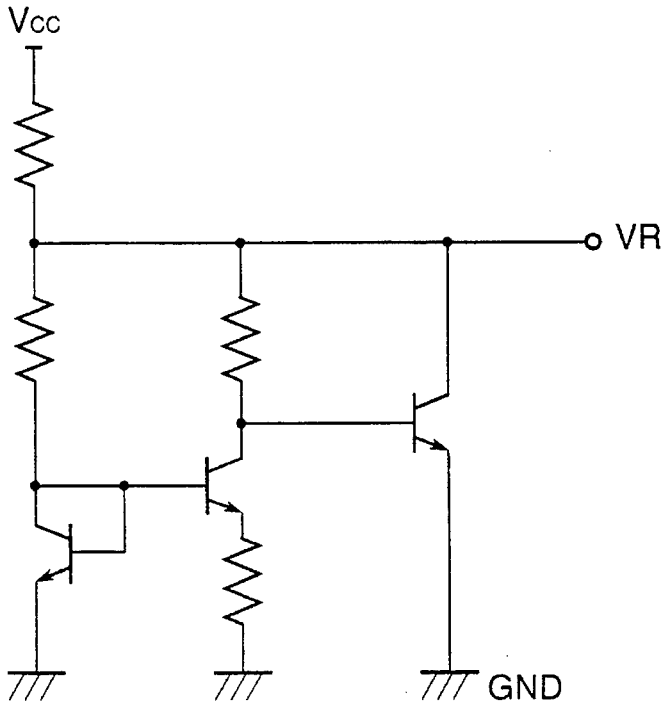
FIGURE 1 PRIOR ART
FIG. 1 is a circuit diagram of a conventional reference potential generating circuit.
Figure 2:
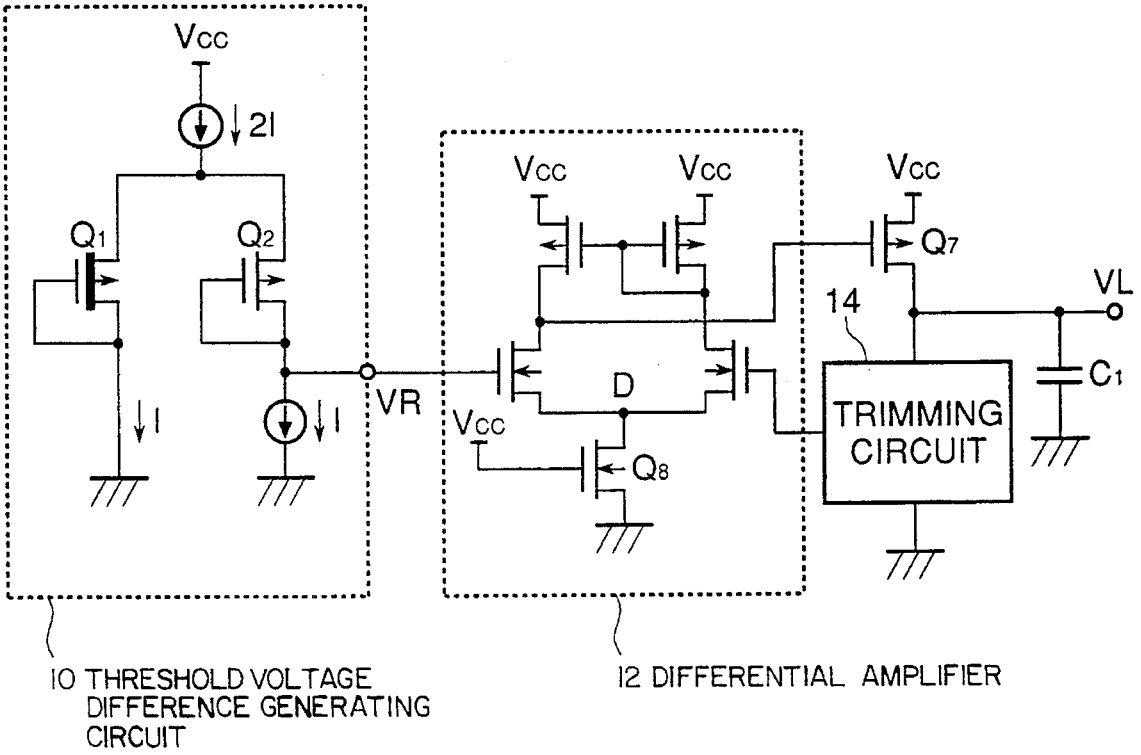
FIGURE 2 PRIOR ART
FIG. 2 is a circuit diagram of another conventional reference potential generating circuit.

In addition, since the shown circuit includes no feedback circuit, there is no possibility of oscillation occurring in the circuit. Therefore, about 100 pF of the compensating capacitor $C_1$ which was required in the conventional example shown in FIG. 2 is no longer necessary, and accordingly, a mask layout of the circuit can be made small, and the consumed current can be reduced to the order of a few microamperes.

Figure 4:
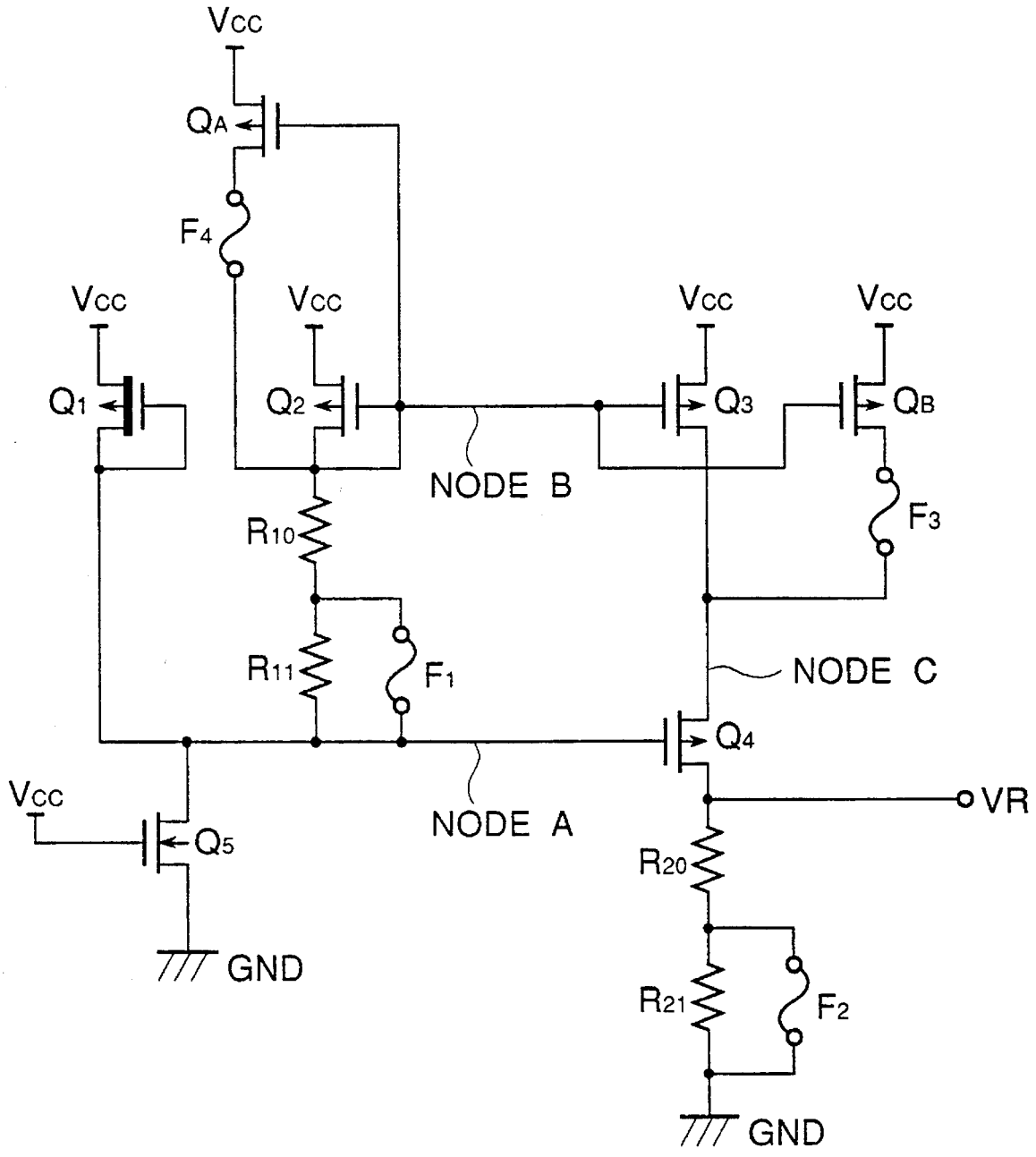
FIG. 4 is a circuit diagram of a second embodiment of the reference potential generating circuit in accordance with the present invention.

Referring to FIG. 4, there is shown a circuit diagram of a second embodiment of the reference potential generating circuit in accordance with the present invention. This second embodiment is characterized in that the first embodiment is added with various means for trimming various parameters after completion of the diffusing process, for the purpose of setting the voltage VR to a desired value. Therefore, in FIG. 4, elements similar or corresponding to those shown in FIG. 3A are given the same Reference Numerals, and explanation thereof will be omitted.

Specifically, a resistor $R_{11}$ is additionally connected in series with the resistor $R_{10}$, and in parallel to the additional resistor $R_{11}$ is connected a fuse $F_1$ which can be blown out or cut off if necessary at the time of trimming. Similarly, a resistor $R_{21}$ is additionally connected in series with the resistor $R_{20}$, and a fuse $F_2$ is connected in parallel to the additional resistor $R_{21}$. This fuse $F_2$ can also be blown out or cut off if necessary at the time of trimming.

Furthermore, a PMOS transistor $Q_A$ is additionally connected in parallel to the transistor $Q_2$ in such a manner that a gate and a source of the PMOS transistor $Q_A$ are connected to the node B and $V_{CC}$, respectively, and a drain of the PMOS transistor $Q_A$ is connected through a fuse $F_4$ to the node B. Similarly, a PMOS transistor $Q_B$ is additionally connected in parallel to the transistor $Q_3$ in such a manner that a gate and a source of the PMOS transistor $Q_B$ are connected to the node B and $V_{CC}$, respectively, and a drain of the PMOS transistor $Q_B$ is connected through a fuse $F_3$ to the node C.

When the voltage VR is measured after completion of the diffusion process, if the voltage VR is higher than a desired value because of variation of the threshold voltage, the voltage VR can be lowered by cutting off the fuse $F_1$, $F_3$ or $F_4$ by means of the trimming. On the other hand, if the voltage VR is lower than a desired value because of variation of the threshold voltage, the voltage VR can be elevated by cutting off the fuse $F_2$ by means of the trimming. In this second embodiment, if a number of resistors $R_{11}$, each connected in parallel to one fuse $F_1$, are additionally connected in series with the resistor $R_{10}$, it is possible to finely adjust the voltage VR to a desired value with a reduced error.

Now, a third embodiment of the reference potential generating circuit in accordance with the present invention will be described. The circuit shown in FIG. 3A is disadvantageous in that, if the voltage supply voltage $V_{CC}$ is smaller than $V_{CCO}$, the voltage VR becomes lower than the desired value. The reason for this is that the voltage VR can never become higher than the potential on the node C. This is a problem in the case that a permissible range of the voltage supply voltage includes a voltage less than $V_{CCO}$.

In addition, the circuit shown in FIG. 3A has another disadvantage that since all of the current flowing through the transistor $Q_3$ must be flowed through the resistor $R_{20}$, it is not allowable to consume a current from the voltage VR. This may become a defect, depending upon the type of a circuit which utilizes the reference potential.

Referring to Figurer 5A, there is shown a circuit diagram of a third embodiment of the reference potential generating circuit configured to overcome the above mentioned two defects. The circuit shown in Figure 5A includes a threshold voltage difference generating circuit 20 which has the same construction as that of the reference potential generating circuit of the first or second embodiment. A voltage VR generated in the threshold voltage difference generating circuit 20 is connected to a differential amplifier 22 of a feedback type circuit for buffering and amplifying the voltage VR so as to generate a reference voltage VL. The voltage VR is connected to a gate of an input NMOS transistor in one of a pair of branches of the differential amplifier 22, and an output of the same branch is connected to a gate of a PMOS transistor $Q_7$ having a source connected to $V_{CC}$. A drain of the transistor $Q_7$ is connected to an output terminal VL, which is grounded through a compensating capacitor $C_1$. The drain of the transistor $Q_7$ also grounded through a pair of series-connected resistors $R_{30}$ and $R_{31}$, which constitute a voltage divider. A connection node of these series-connected resistors $R_{30}$ and $R_{31}$ is connected to a gate of an input NMOS transistor in the other branch of the differential amplifier 22.

Figure 5A:
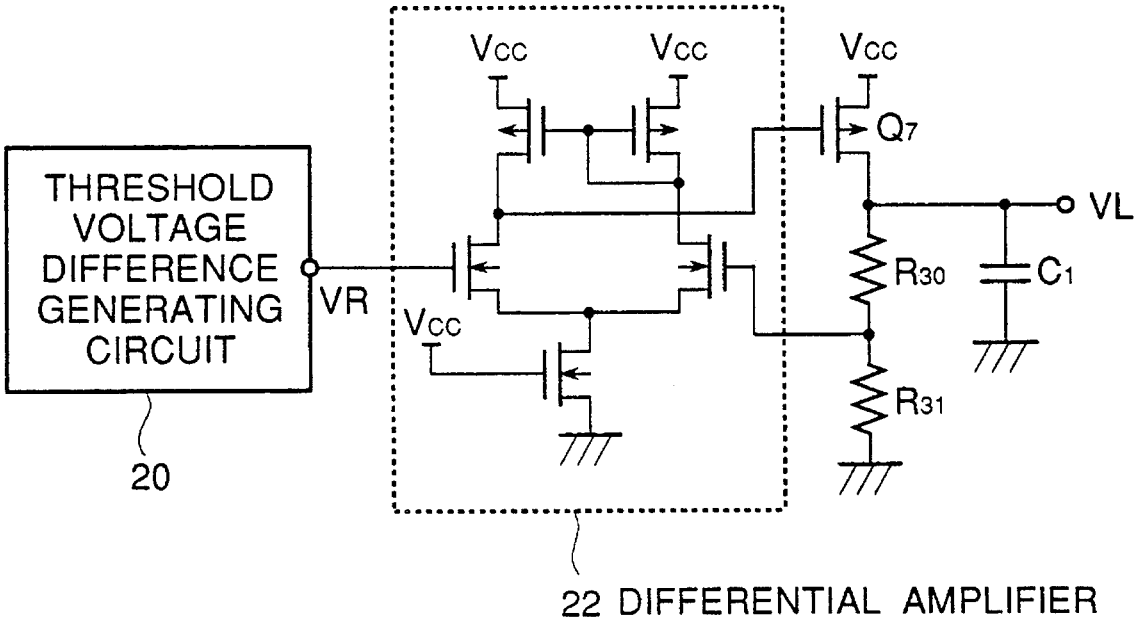
FIG. 5A is a circuit diagram of a third embodiment of the reference potential generating circuit in accordance with the present invention.
Figure 5B:
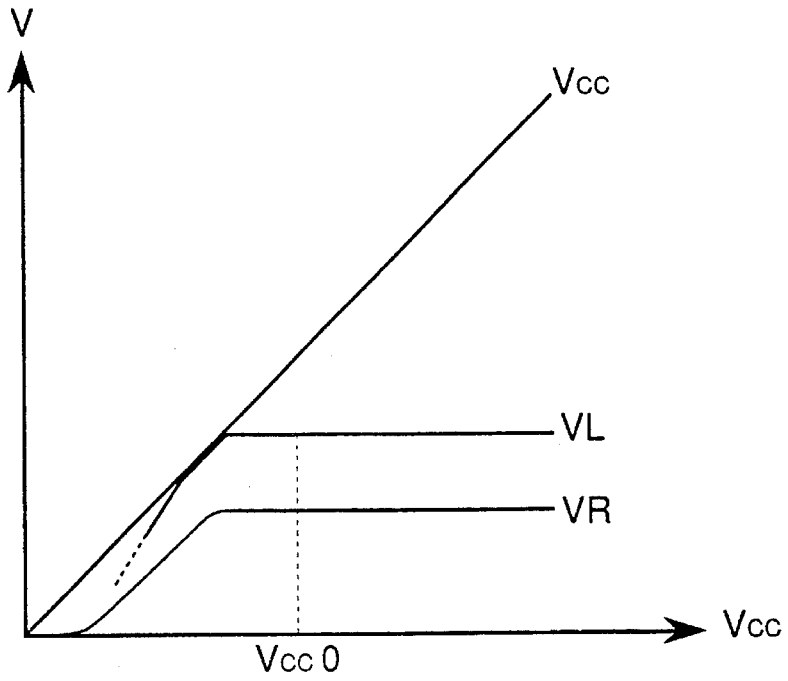
FIG. 5B is a graph illustrating potential changes on various internal nodes in the circuit shown in FIG. 5A.

Referring to FIG. 5B, there is shown a graph illustrating dependency between the voltages VR and VL in the circuit shown in FIG. 5A and the voltage supply voltage $V_{CC}$. In this third embodiment, the voltage VR is set at a value which is within a range of 1 V or more but which is lower than that set in the first embodiment, but a desired reference voltage VL can be obtained by amplifying the voltage VR by an amplification factor determined by a ratio in resistance between the resistors $R_{30}$ and $R_{31}$.

In the third embodiment, accordingly, even if $V_{CC}<V_{CCO}$, a desired voltage can be obtained as the reference voltage VL. In addition, even if a circuit utilizing the reference voltage VL consumes a current from the terminal VL, the reference voltage VL can be maintained at a constant value.

Since the third embodiment has the circuit construction of the feedback type circuit including the differential amplifier, similarly to the conventional example shown in FIG. 2, in order to prevent oscillation, it is necessary that the capacitance of a compensating capacitor $C_1$ is about 100 pF, and a total consumed current of the reference potential generating circuit reaches at least about 20 μA. However, even if the threshold voltage difference is as small as 1 V or less, the reference voltage can be amplified to a level of not smaller than 1 V, which is sufficient to cause a differential amplifier to operate quickly. On the other hand, the process for diffusing the N-type impurities to the channel region of the PMOS transistor for the purpose of enlarging the absolute value of the threshold of the PMOS transistor, which was required in the conventional circuit, is no longer necessary. In other words, the third embodiment can sufficiently operate with the threshold determined by the N-well impurity concentration. The third embodiment can be easily manufactured with a conventional CMOS manufacturing process, and therefore, the manufacturing cost does not increase.

The invention has thus been shown and described with reference to the specific embodiments. However, it should be noted that the present invention is in no way limited to the details of the illustrated structures but changes and modifications may be made within the scope of the appended claims.

I claim:

1. A reference potential generating circuit using MOS transistors having different thresholds and configured to generate a reference potential by amplifying a difference between the thresholds of the MOS transistors, the reference potential generating circuit comprising: a first PMOS transistor having its gate and its drain connected in common to a first node and its source connected to a high voltage supply voltage; a second PMOS transistor having its gate and its drain connected in common to a second node and its source connected to said high voltage supply voltage; a first resistor connected between said first node and said second node; a first current source connected between said first node and a low voltage supply voltage; a third PMOS transistor having its gate connected to said second node, its drain connected to a third node and its source connected to said high voltage supply voltage; a fourth PMOS transistor having its source connected to said third node, its gate connected to said first node and its drain connected to a fourth node; and a second resistor connected between said fourth node and said low voltage supply voltage, the reference potential being generated from said fourth node.

2. A reference potential generating circuit claimed in claim 1 further including a means for adjusting a resistance of said first resistor.

3. A reference potential generating circuit claimed in claim 1 further including a means for adjusting a resistance of said second resistor.

4. A reference potential generating circuit claimed in claim 1 further comprising at least one PMOS transistor connected in parallel to said second PMOS transistor, and further including a means for selectively separating said at least one PMOS transistor to adjust a current flowing through said first resistor.

5. A reference potential generating circuit claimed in claim 1 further comprising at least one PMOS transistor connected in parallel to said third PMOS transistor, and further including a means for selectively separating said at least one PMOS transistor to adjust a current flowing through said fourth PMOS transistor.

6. A reference potential generating circuit claimed in claim 1 further including a differential amplifier circuit having an input connected to said fourth node, for buffering and amplifying said reference voltage appearing on said fourth node.

* * * * *

UNITED STATES PATENT AND TRADEMARK OFFICE

CERTIFICATE OF CORRECTION

PATENT NO. : 5,467,052

DATED : November 14, 1995

INVENTOR(S) : Shyuichi Tsukada

It is certified that error appears in the above-indentified patent and that said Letters Patent is hereby corrected as shown below:

Col. 1, line 29, delete "ease" and insert --case--.

Signed and Sealed this

Seventh Day of May, 1996

Bruce Lehman

*Attest:*

BRUCE LEHMAN

*Attesting Officer*

*Commissioner of Patents and Trademarks*